United States Patent [19]

Nardi

[11] Patent Number: 4,603,241

[45] Date of Patent: Jul. 29, 1986

[54] ELASTIC STRIP WITH CONTACTS FOR DETECTING THE TRANSIT OF MOTOR VEHICLES WITH A PROTECTION AGAINST WEAR

[76] Inventor: Eliana Nardi, Via Colletta n. 21, Firenze, Italy, 50136

[21] Appl. No.: 663,060

[22] Filed: Oct. 19, 1984

[30] Foreign Application Priority Data

Oct. 21, 1983 [IT] Italy ..... 11888/83[U]

[51] Int. Cl.[4] ..... H01H 13/16

[52] U.S. Cl. ..... 200/86 R; 340/940

[58] Field of Search ..... 200/86 R, 86 A, 86.5, 200/153 C, 83 Z, 159 B, 333; 340/626, 666, 933, 934, 940

[56] References Cited

U.S. PATENT DOCUMENTS

| | | | |
|---|---|---|---|
| 2,975,350 | 3/1961 | Mahoney | 200/86 R |
| 3,617,666 | 11/1971 | Braue | 200/86 R |
| 3,721,784 | 3/1973 | Viracola | 200/86 A |
| 3,732,384 | 5/1973 | Fischel | 200/86 R |
| 4,273,974 | 6/1981 | Miller | 200/86 R |

FOREIGN PATENT DOCUMENTS

| | | | |
|---|---|---|---|
| 2516421 | 11/1976 | Fed. Rep. of Germany | 200/83 Z |

*Primary Examiner*—G. P. Tolin

*Attorney, Agent, or Firm*—Hopgood, Calimafde, Kalil, Blaustein & Judlowe

[57] ABSTRACT

An elastic strip with inside electrical contacts and trapezoidal geometry for the detection of the transit of vehicles includes a deformable body made of an elastomeric material with a central cavity for metal contact elements. About the central cavity are a pair of channels which operate through structural shape deformation during compression to minimize shear stress on the strip. The upper surface of the strip is provided with a protective longitudinal armor-like surface part, made of metal or other suitable material which comes in contact with the wheels of vehicles.

10 Claims, 2 Drawing Figures

ELASTIC STRIP WITH CONTACTS FOR DETECTING THE TRANSIT OF MOTOR VEHICLES WITH A PROTECTION AGAINST WEAR

BACKGROUND OF THE INVENTION

The present invention relates to an elastic strip with internal electric contacts for the detection of vehicle transit, comprising a structural shape made of rubber or the like with cavities for metal contact elements, which operate through the structural shape deformation when a load is applied thereto.

SUMMARY OF THE INVENTION

According to the invention, in order to increase the resistance to wear, the top surface of the structural shape is provided with a protective longitudinal armor-like surface part made of metal or other suitable material, which comes in contact with the wheels of the transit vehicles.

In one embodiment the protective surface part is a metal plate. The plate may be limited in width to ensure the structural shape deformation, especially in the fillet or joining zones sideways defining the cavity. The plate and the plate-like contact elements may be made integral with the strip upon the molding operation of the rubber structural shape of the same strip.

Preferably, the structural shape cross section comprises a portion with the approximate configuration of an isosceles trapezoid. Atop the trapezoid-like section there is provided an upper portion with a semi-circular shape with the base thereof adjacent a side of the trapezoidal portion. A cavity is located generally below the trapezoid where a pair of contact plates are mounted. The upper contact plate corresponds to the lower side of the trapezoid, parallel to the base of the circular portion. On the sides of the cavity a pair of channels is provided in order to improve the flexing properties of the device.

BRIEF DESCRIPTION OF THE DRAWINGS

The drawing shows one embodiment of the invention elastic strip and in particular.

DESCRIPTION OF THE PREFERRED EMBODIMENT

Figure 1:
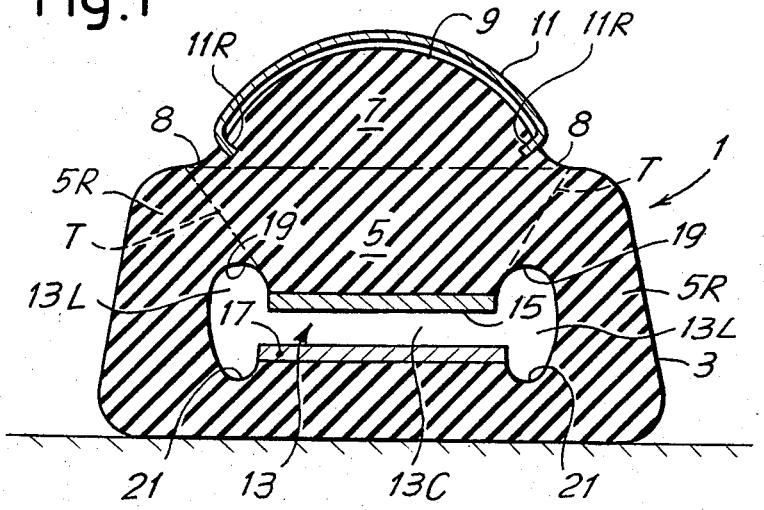
FIG. 1 shows a sectional schematic view of the strip for the detection of transit vehicles according to the invention.
Figure 2:
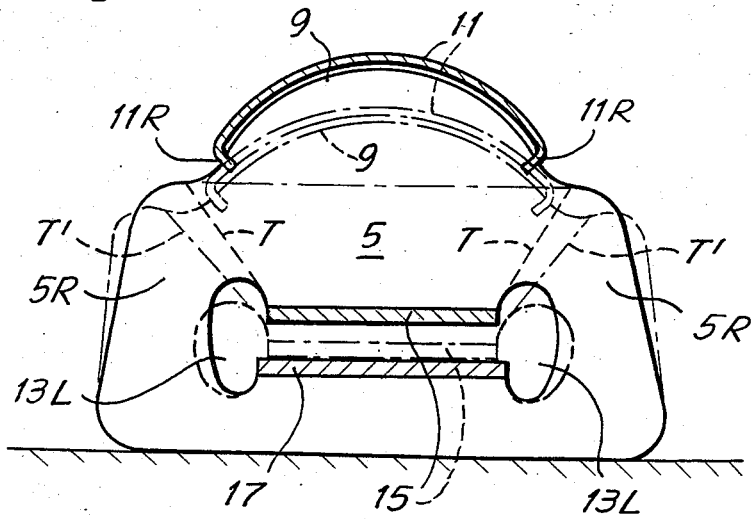
FIG. 2 shows a view similar to the one in FIG. 1, but schematically illustrating the arrangement of the strip cross section as it is deformed by the load due to the transit vehicle wheels.

In the accompanying drawing, there is shown a strip with inside electrical contacts for the detection of transit vehicles, generally indicated by 1. The strip is formed is of a segment of suitable length (generally equal to about the roadway width) of a structural shape 3 made of rubber or other elastomer having suitable characteristics, the cross-section of which is shown in FIG. 1. The cross-section comprises a lower portion 5 approximately with the shape of an isosceles trapezoid with the vertices being radiused—delimited in the drawing, by way of illustration only, in the upper part, by a partition chain line. Portion 5 is surmounted by a portion 7 whose shape is approximately that of a semi circle. Suitable strips 8 join the outlines of portions 5 and 7. To the arc-shaped part of portion 7 protective surface plate 11 is applied, and positioned so as to come in contact with the wheels of the transit vehicles. The plate 11 is mostly metallic and follows the approximate arc shape of part 9 and, owing to the above described cross section of the structural-shape 3 (i.e. the portion 7 has a base which matches a side of the portion 5) ensures the structural shape deformations pattern in the presence of a load, especially in the fillet or joining zones 5R. The fillet zones 5R are located sideways in the cross-section and define an inner cavity 13, in which the horizontal plate-like contact elements 17 and 17 are located plate 11 may be made of metal or other suitable material such as nylon, reinforced plastic material, or others still with the purpose to avoid the direct contact between the wheels of the transit vehicles and the rubber of the structural-shape. In some cases this object can be obtained, rather than by a curved plate as in the drawing, by means of a narrow slat embedded in the cross-section portion 7, having preferably an arc-shaped upper configuration. As can be seen in FIG. 2—in which by a dashed line the deformed arrangement of the structural shape cross section 3 due to the load of a transit wheel is indicated—such deformations, owing also to the configuration of the side portions 13L of the cavity 13, give rise to stresses of almost exclusively compression type in the material of the structural shape. On the other hand shear and tensile stresses are of modest or even negligeable magnitude. This is very important for extended strip life. Inside the structural shape 3 the cavity 13 extends longitudinally, the cross section of which has a central portion 13C with the upper and lower edges being substantially parallel. Side portions 13L of cavity 13 have a curvilinear routine and, with respect to a horizontal center line, are asymmetric. The outline of each portion 13L defines, at the inside of structural shape 3, an upper channel 19 and a lower channel 21, opposite to each other. The cross section of channel 19 is substantially wider and also slightly deeper than that of channel 21. The structural shape 3 is obtained by compression molding and, simultaneously to the molding operation, it is provided with the metallic plate 11 as well as the plate-like contact elements 15 and 17, which accordingly are anchored at the rubber. In some cases the anchorage of the plate-like elements 15 and 17 at the rubber is carried out by means of adhesive. As a rule, the metallic plate 11 is made of stainless steel, whereas the elements 15 and 17 are made of carbon steel or other suitable material with, if so desired surface treatment. Because of the repeated stresses to which the plate 11 is subjected to in use, it became even more anchored to the material of lower portion 7 by flaps 11R bent almost at right angle, that is, radially with respect to portion 7. Since the contacts inside each strip must be waterproof, the ends of cavity 13 are sealed at one extremity by a rubber closing element fixed by means of vulcanization, while at the other extremity there is applied an analogous rubber closing terminal, also fixed by means of vulcanization. The closing terminal has a bipolar small cable whose leads are each connected to one of the two plates 15 and 17. The cable connects the strip to an electric or electronic device for detecting the passage of vehicles over the strip.

The advantages of the strip according to the invention should be apparent. The presence of the plate 11 reduces, and in fact eliminates the wear of the strip contact ridge part, which, instead, is the plate 11 eliminates also the possibility that the ridge of the strip will be perforated or cut by the passage of wheels with skid chains or riveted tires perforations or cuts cause electric insulation loss which might short circuit or otherwise render the strip ineffective. Finally, it is very important to note the deformation pattern shown in FIG. 2, where deformation due to a load is shown in dotted lines. In FIG. 2 lines T and T′ indicate respectively the deformation about the zones 5R. As may be seen from the Figure, on which about half the load acting on the strip at the passage of a transit wheel is directed sideways (and about perpendicularly to lines T and T′). As it will be readily seen, lines T and T′ are substantially parallel, which shows that the fillet zones 5R are mainly compression stressed, whereby the bending and shear stresses, if present in significant amounts at all, are relatively small. This condition assures a strip life markedly longer than that of the conventional strips, whose wear (with consequent flaws or tearings) was mostly due, in the zones flanking the ridge part, to bending and shear stresses.

What is claimed is:

1. A strip for detecting the passage of motor vehicles comprising in combination:

a deformable body made of an elastomeric material defining an elongated cavity with two load directing channels extending along either side of the central portion of said cavity so as to define upper and lower central projections therebetween, the upper central wall of said cavity being substantially planar and having secured thereto a first switch member, the lower wall of said central portion of said cavity having secured thereto a second switch member, a semi-circular upper portion surmounting said deformable body for contacting the wheels of motor vehicles as they pass thereover, said deformable body having sidewalls extending a substantial distance on either side of the base of said semi-circular portion and a substantial distance about said load-directing channels, the base of said semi-circular portion being larger than the upper planar wall of said cavity and in spaced parallel relation thereto, so that said base and said upper wall define generally a trapezoid, the ends of said base of said semi-circular portion extending laterally further than the ends of said upper wall of said central portion of said cavity so that a lower, shorter side of said trapezoid is disposed between said channels, whereby upon application of a load onto said strip by a passing motor vehicle said sidewalls, channels and cavity cooperate so that said body deforms such that the respective sides of said trapezoid remain substantially parallel to their orientation in the relaxed state of said strip, thereby minimizing the shear stresses applied to said strip when it is compressed to bring into contact said switch members.

2. The motor vehicle-detecting strip according to claim 1, wherein said load-directing channels are arcuate at their upper and lower extremes, the upper arcuate extremities of said channels extending more shallowly into said body and having a larger radius of curvature than the lower arcuate extremities of said channels.

3. The motor vehicle-detecting strip according to claim 2, wherein said semi-circular portion is provided with a semi-circular protective plate with a securing flap on either end extending radially inwardly into said semi-circular portion.

4. The motor vehicle-detecting strip according to claim 3, wherein said deformable body is formed by molding and said first and second switch members are secured to said body during the molding thereof.

5. The motor vehicle-detecting strip according to claim 2, wherein said semi-circular portion is molded and integrally formed with said deformable body and said protective plate is attached to said semi-circular portion during the molding thereof.

6. The motor vehicle-detecting strip according to claim 1, wherein said lower wall of said central portion is substantially planar.

7. The motor vehicle-detecting strip according to claim 1, wherein the upper surface of said semi-circular member is provided with a protective plate formed of a relatively hard material.

8. The motor vehicle-detecting strip according to claim 4, wherein said protective plate is formed of metal.

9. The motor vehicle-detecting strip according to claim 1, wherein said trapezoid is an isoceles trapezoid.

10. The motor vehicle-detecting strip according to claim 1, wherein said deformable body is of substantially rectangular cross-section.

* * * * *